US010443607B2

(12) United States Patent
Brown et al.

(10) Patent No.: US 10,443,607 B2
(45) Date of Patent: Oct. 15, 2019

(54) BLADE FOR AN AXIAL FLOW MACHINE

(71) Applicant: ROLLS-ROYCE plc, London (GB)

(72) Inventors: William J Brown, Derby (GB); Christopher R P Hall, Derby (GB); Anthony M J Dickens, Cambridge (GB); James V Taylor, Cambridge (GB)

(73) Assignee: ROLLS-ROYCE plc, London (GB)

( * ) Notice: Subject to any disclaimer, the term of this patent is extended or adjusted under 35 U.S.C. 154(b) by 339 days.

(21) Appl. No.: 15/459,878

(22) Filed: Mar. 15, 2017

(65) Prior Publication Data

US 2017/0292528 A1 Oct. 12, 2017

(30) Foreign Application Priority Data

Apr. 11, 2016 (GB) ..... 1606105.3

(51) Int. Cl.
*F04D 29/32* (2006.01)
*F01D 5/14* (2006.01)

(52) U.S. Cl.
CPC ..... *F04D 29/324* (2013.01); *F01D 5/141* (2013.01); *F05D 2220/32* (2013.01); (Continued)

(58) Field of Classification Search
CPC ... F01D 5/12; F01D 5/14; F01D 5/141; F01D 5/148; F05D 2240/122; F05D 2240/301; (Continued)

(56) References Cited

U.S. PATENT DOCUMENTS 4,080,102 A * 3/1978 Schwab ..... F01D 5/141 416/223 A
2006/0275134 A1* 12/2006 Hasenjager ..... F01D 5/141 416/237

(Continued)

FOREIGN PATENT DOCUMENTS

DE 298 25 097 U1 3/2005
DE 10 2005 025 213 A1 12/2006

(Continued)

OTHER PUBLICATIONS

WO 2017025995 A1 (Tsuruta et al.) Feb. 16, 2017 (Machine Translation). [online] [retrieved on Apr. 11, 2019]. Retrieved from: EPO Database (Year: 2017).*

(Continued)

*Primary Examiner* — Christopher Verdier
*Assistant Examiner* — Elton K Wong
(74) *Attorney, Agent, or Firm* — Oliff PLC

(57) ABSTRACT

A blade for an axial flow machine having a pressure surface, suction surface and trailing edge. The blade has a cross-sectional aerofoil profile including: a region of maximum curvature corresponding to the trailing edge of the blade and defining a trailing edge radius of curvature r; a trailing edge region extending from the trailing edge and having a chord-wise extent equal to curvature r's trailing edge radius; a taper region adjacent the trailing edge region, the taper region having a chordwise extent greater than the curvature r's trailing edge radius and no more than 15% of the blade's chord; a body region adjacent the taper region; a pressure surface boundary corresponding to the blade's pressure surface; and a suction surface boundary corresponding to the blade's suction surface. A thickness between the pressure and suction surface boundaries reduces within the taper region towards the trailing edge by at least 50%.

18 Claims, 14 Drawing Sheets

(52) U.S. Cl.
CPC .. *F05D 2240/301* (2013.01); *F05D 2240/304* (2013.01); *F05D 2250/70* (2013.01)

(58) Field of Classification Search
CPC ..... F05D 2240/304; F05D 2250/70; F04D 29/324
See application file for complete search history.

(56) References Cited

U.S. PATENT DOCUMENTS

| | | | | |
|---|---|---|---|---|
| 2014/0112795 | A1* | 4/2014 | Hamabe ..... | F01D 5/14 416/223 R |
| 2015/0285080 | A1 | 10/2015 | Huebner et al. | |

FOREIGN PATENT DOCUMENTS

| | | | | |
|---|---|---|---|---|
| EP | 2 360 377 | A2 | 8/2011 | |
| EP | 2634087 | A2 | 9/2013 | |
| EP | 2 927 427 | A1 | 10/2015 | |
| WO | WO-2017025995 | A1 * | 2/2017 ..... | F01D 5/14 |

OTHER PUBLICATIONS

Nov. 24, 2016 Search Report issued in Great Britain Patent Application No. GB1606105.3.
Aug. 3, 2017 Search Report issued in European Patent Application No. 17 16 1042.

* cited by examiner

BLADE FOR AN AXIAL FLOW MACHINE

The disclosure relates to a blade for an axial flow machine. In particular, although not exclusively, the disclosure relates to a blade for a compressor of a gas turbine engine.

Compressors raise the pressure of air entering an intake of a gas turbine engine prior to combustion. Compressors typically comprise one or more rotor assemblies (or rotor stages), each having a plurality of rotor blades attached thereto. The rotor assemblies are driven by one or more turbines. The rotor blades impart kinetic energy into the air passing through the compressor, which is subsequently converted into static pressure as it slows through a stator assembly (or stator stage). However, losses in the compressor may limit the efficiency of the gas turbine engine, thereby affecting fuel efficiency.

It may therefore be desirable to provide an improved blade for an axial flow machine.

According to a first aspect of the disclosure, there is provided a blade for an axial flow machine having a pressure surface, a suction surface and a trailing edge. The blade has a cross-sectional aerofoil profile comprising: a region of maximum curvature corresponding to the trailing edge of the blade and defining a trailing edge radius of curvature; a trailing edge region extending from the trailing edge and having a chordwise extent equal to the trailing edge radius of curvature; a taper region adjacent the trailing edge region, the taper region having a chordwise extent greater than the trailing edge radius of curvature and no more than 15% of the chord of the blade; a body region adjacent the taper region; a pressure surface boundary corresponding to the pressure surface of the blade; and a suction surface boundary corresponding to the suction surface of the blade. A thickness between the pressure surface boundary and the suction surface boundary reduces within the taper region towards the trailing edge by at least 50%. Accordingly, the trailing edge radius of curvature may be less than half of the thickness of an end of the taper region adjacent the body region.

The region of maximum curvature corresponding to the trailing edge of the blade is therefore a local region of maximum curvature at or towards the trailing edge of the blade. Accordingly, the region of maximum curvature corresponding to the trailing edge of the blade may not include other local maximums around the blade, such as at a leading edge, even if the maximum curvature at such regions away from the trailing edge is greater. As will be appreciated, the trailing edge generally denotes the rear end of the blade.

The taper region may have a chordwise extent of no more than 12%, or no more than 10% of the chord of the blade.

The chordwise extent of the taper region may be no more than 30 times the trailing edge radius of curvature, for example, no more than 20 or no more than 15 times the trailing edge radius of curvature.

The thickness in the taper region may reduce by at least 50%, at least 60%, at least 70% or at least 80%.

The blade may further comprise a leading edge region having a chordwise extent of between 5% and 15% of the chord of the blade. The body region may extend between the leading edge region and the taper region.

The maximum absolute curvature of at least one of the pressure surface boundary and the suction surface boundary in the taper region may be greater than a maximum absolute curvature of the respective pressure surface boundary and the suction surface boundary in the body region.

The curvature of the pressure surface boundary and/or the suction surface boundary may be continuous in the taper region. The curvature of the pressure surface boundary and/or the suction surface boundary may be continuous throughout the taper region and the trailing edge region. In the present disclosure, a continuously varying curvature, or a continuous curvature profile, is intended to mean that there are no discontinuities in the profile of curvature (i.e. no sudden changes in curvature).

Therefore, a curvature profile which is continuous may include regions of constant curvature, regions of zero curvature, and regions of varying curvature, both positive and negative.

The curvature of the pressure surface boundary and/or the suction surface boundary may be continuous between the taper region and the body region.

The curvature of the pressure surface boundary and/or the curvature of the suction surface boundary may change sign from positive to negative in the taper region, when the normal direction of curvature is inward. Controlling the curvature profile to change sign from positive to negative in the taper region may enable the respective boundary to initially curve in an inward direction (i.e. toward the camber line) to define a steep reduction in thickness to be followed by, and curve back in an outward direction to enable the direction of flow along the respective boundary to recover.

A portion of the pressure surface boundary and/or the suction surface boundary may have zero curvature in the taper region.

The profile (or contour) of the suction surface boundary in the taper region may be substantially continuous with the profile of the suction surface boundary in the body region. The profile of the pressure surface boundary in the taper region may depart from the profile of the pressure surface boundary in the body region towards the suction surface boundary, such that the aerofoil profile of the blade is biased towards the suction surface in the taper region and the trailing edge region.

The profile (or contour) of the pressure surface boundary in the taper region may be substantially continuous with the profile of the pressure surface boundary in the body region. The profile of the suction surface boundary in the taper region may depart from the profile of the suction surface boundary in the body region towards the pressure surface boundary, such that the aerofoil profile of the blade is biased towards the pressure surface in the taper region and the trailing edge region.

Biasing the aerofoil profile towards a respective surface of the blade may enable a desired exit flow direction of the blade to be achieved. Further, biasing the aerofoil profile towards a respective surface of the blade may enable the reduction in thickness to be effected by relatively larger changes in curvature or deflection in one of the boundaries (i.e. the pressure surface boundary and the suction surface boundary) than the other. This may be desirable, for example, when the flow regime along one of the boundaries is more sensitive to design changes. For example, the flow along one of the boundaries may be able to tolerate such changes in the curvature profile than flow along the other boundary (e.g. resistance to separation).

A portion of the camber line of the aerofoil profile may be deflected (or may depart) in the taper region relative to a portion of the camber line in the body region.

The curvature of the camber line in the taper region may increase relative the curvature of the camber line in the body region, when the normal direction is towards the pressure surface. The camber line may be inflected in the taper region. Controlling the curvature of the camber line in the taper region may enable the exit flow angle of the blade to be controlled, as described above. Further, controlling the curvature of the camber line may allow the aerofoil profile in the taper region to be biased towards one of the suction surface and the pressure surface of the blade, as described above.

The pressure surface boundary and the suction surface boundary may be substantially symmetrical in the taper region and the trailing edge region. In other words, the camber line may be linear in the taper region and the trailing edge region.

The region of maximum curvature may form an arc of a circle. The arc of the circle formed by the region of maximum curvature corresponding to the trailing edge may have an angular extent of at least 60°, for example at least 90° or at least 110°. The arc of the circle formed by the region of maximum curvature corresponding to the trailing edge may be no more than 180°. However, the region of local maximum curvature corresponding to the trailing edge may correspond to a peak curvature of a variable curvature profile, such that the region of maximum local curvature does not have an appreciable arcuate extent. An arcuate region of constant maximum curvature corresponding to the trailing edge may enable more efficient manufacture and/or quality control.

The curvature of the pressure surface boundary and/or the suction surface boundary may be substantially constant in the body region.

In some examples, the minimum radius of curvature (corresponding to the maximum absolute curvature) along each of the pressure surface boundary and/or the suction surface boundary may be no less than the chord length of the blade. The curvature of the pressure surface boundary and/or the suction surface boundary in the body region may generally correspond to the curvature of the camber line of the aerofoil profile.

In some examples, the minimum radius of curvature along the pressure surface boundary and/or the suction surface boundary in the trailing edge region (i.e. the trailing edge radius of curvature) may be no more than 2% of the chord length of the blade, or no more than 1% of the chord length of the blade. In some examples, the minimum radius of curvature along the pressure surface boundary and/or the suction surface boundary in the trailing edge region (i.e. the trailing edge radius of curvature) may be no more than 20% of the maximum thickness of the aerofoil profile, no more than 15% of the maximum thickness of the aerofoil profile, or no more than 10% of the maximum thickness of the aerofoil profile.

According to a second aspect of the disclosure there is also provided a compressor blade in accordance with the first aspect of the disclosure for a compressor of an axial flow machine, such as a gas turbine engine. The compressor may be a core compressor for a gas turbine, in other words, a compressor downstream of a fan stage arranged to compress a core flow through the engine (rather than a bypass flow). In other examples, the compressor may include a fan stage. In example gas turbine engines, a fan stage may be mounted on (i.e. rotationally coupled with) a separate shaft from a core compressor.

According to a third aspect of the disclosure there is provided a multi-stage axial compressor comprising a plurality of rotor stages and a plurality of stator stages, at least one rotor stage or stator stage comprising a compressor blade in accordance with the second aspect of the disclosure. The at least one rotor or stator stage may comprise a plurality of such compressor blades. Each rotor or stator stage may comprise a plurality of such compressor blades.

There may also be provided a gas turbine engine comprising a compressor blade in accordance with the first or second aspects of the disclosure, or a multi-stage axial compressor in accordance with the third aspect of the disclosure.

The invention may comprise any combination of the features and/or limitations referred to herein, except combinations of such features that are mutually exclusive.

Arrangements will now be described, by way of example, with reference to the accompanying drawings, in which:

FIG. 1 schematically shows a gas turbine engine having a compressor;

FIG. 2 schematically shows a partial cross-sectional side view of the compressor;

FIG. 3 schematically shows a partial cross-sectional plan view of the compressor;

Figure 9:
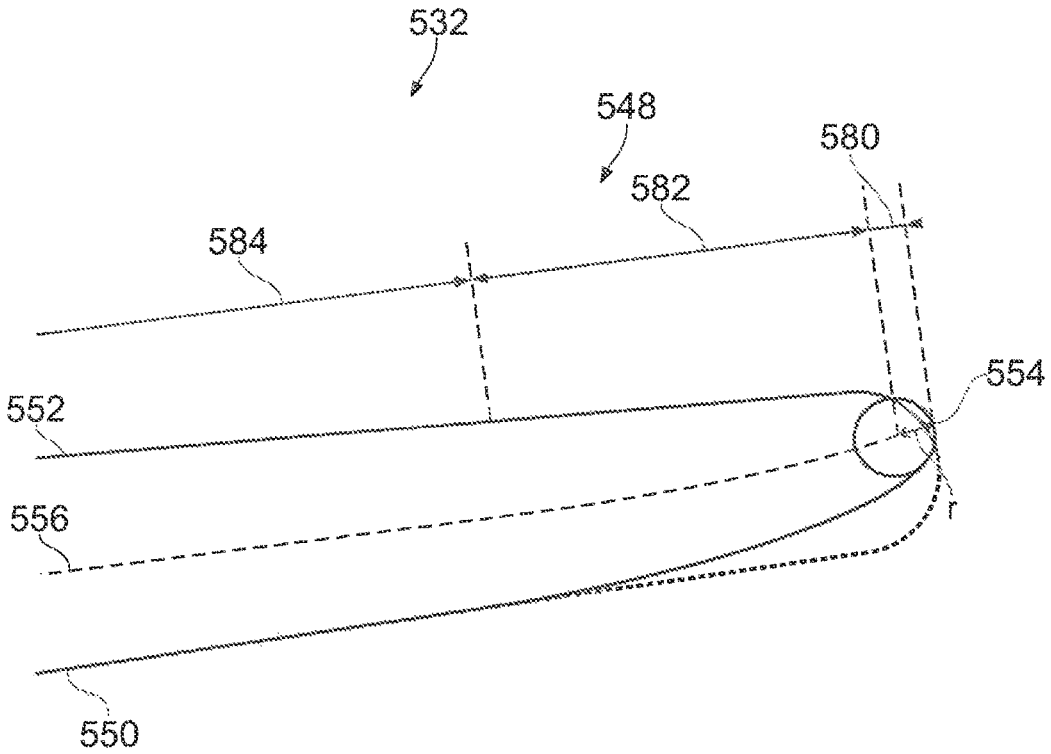
FIG. 9 shows a cross-sectional profile of an end region of a compressor blade according to a fifth example.
Figure 10:
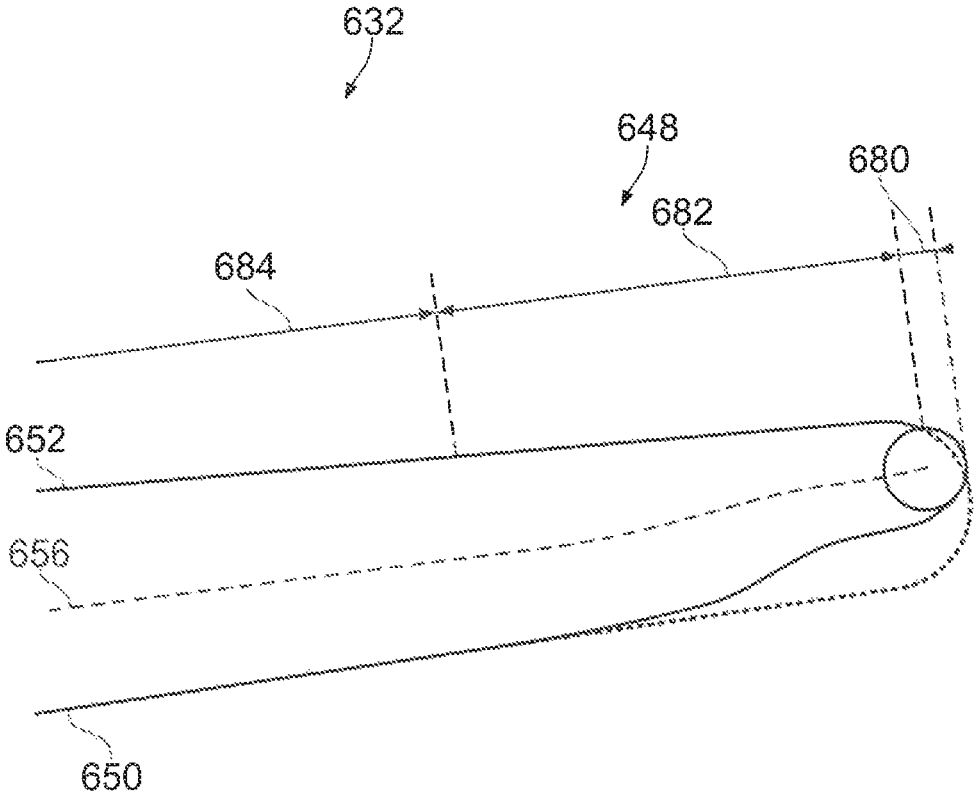
FIG. 10 shows a cross-sectional profile of an end region of a compressor blade according to a sixth example.
Figure 11:
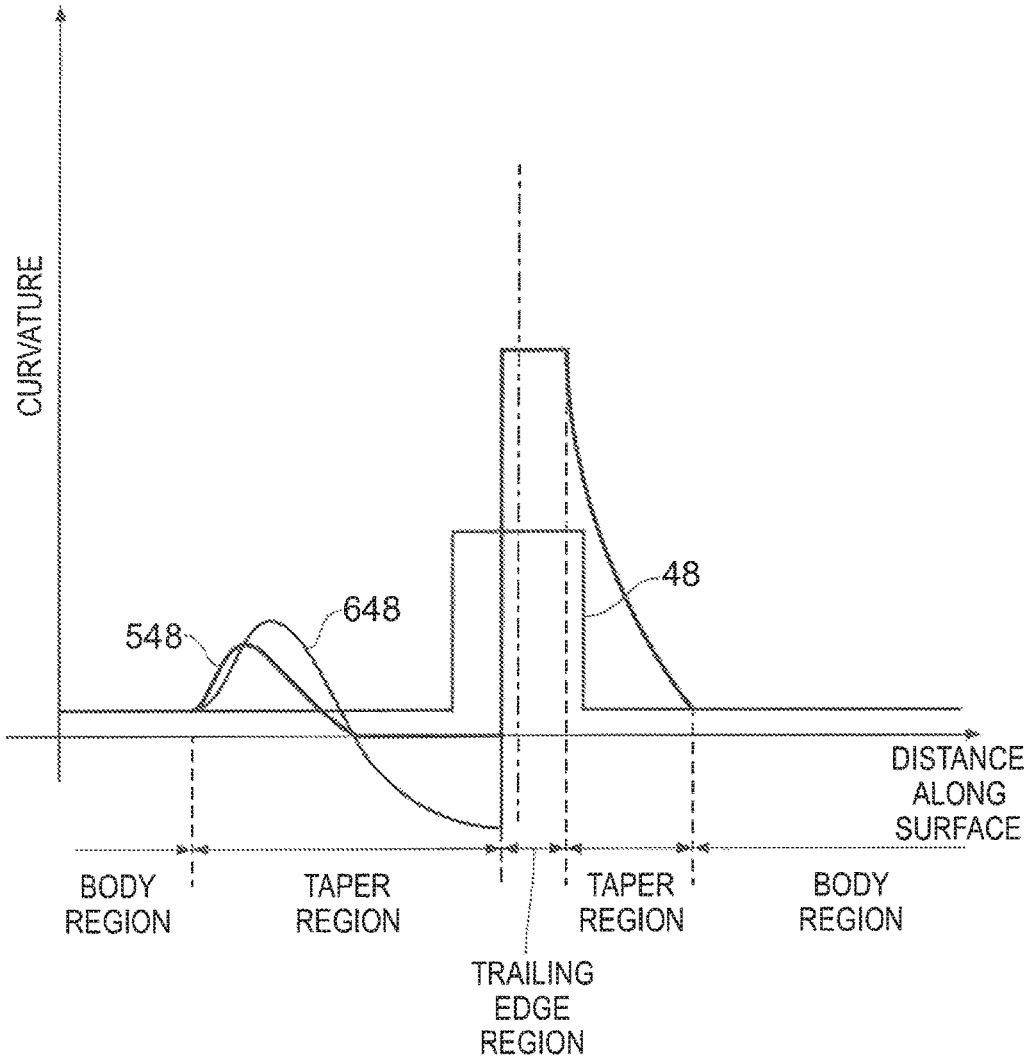
Figure 12:
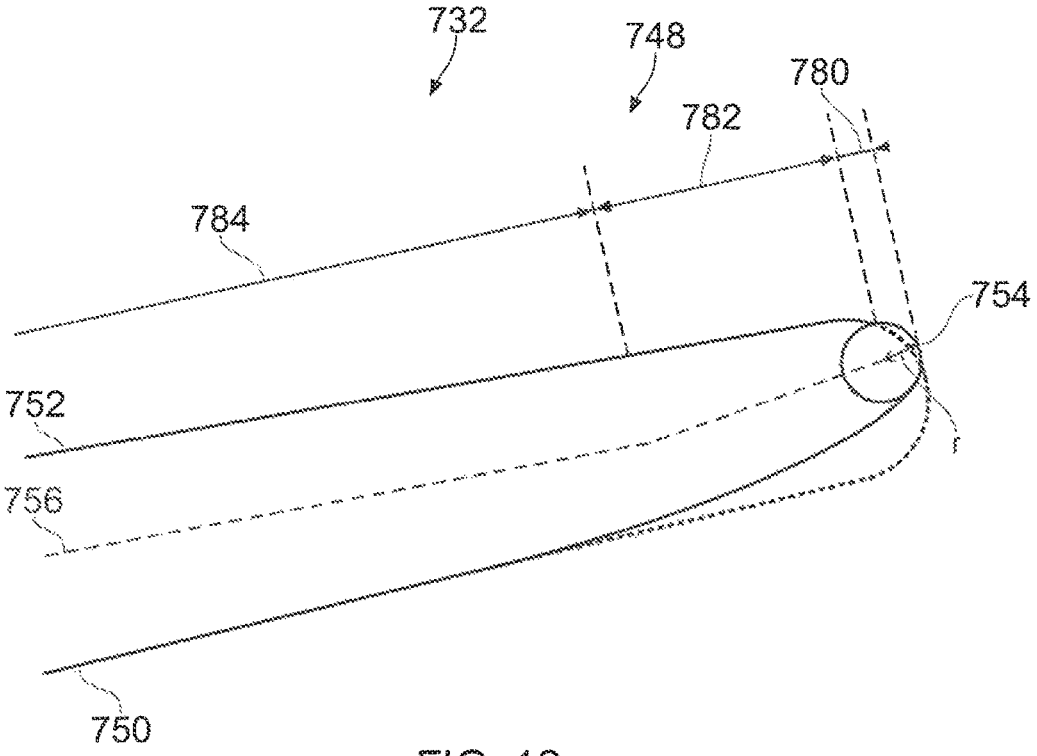
Figure 13:
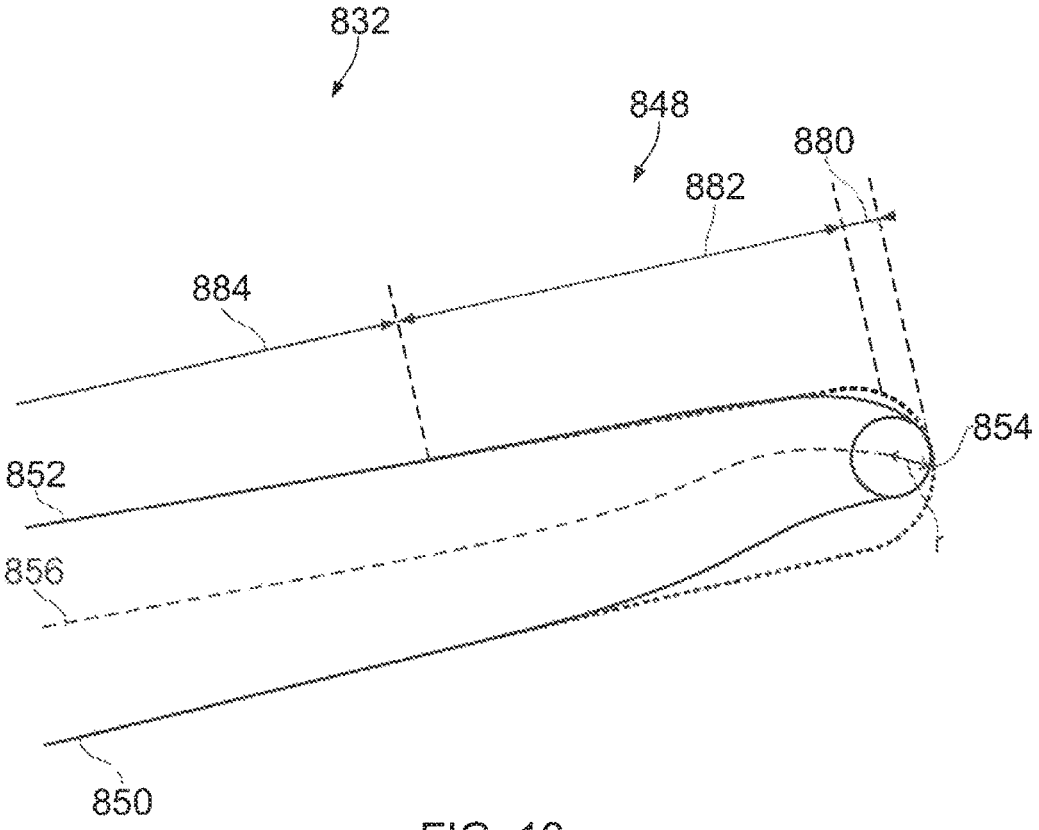
Figure 14:
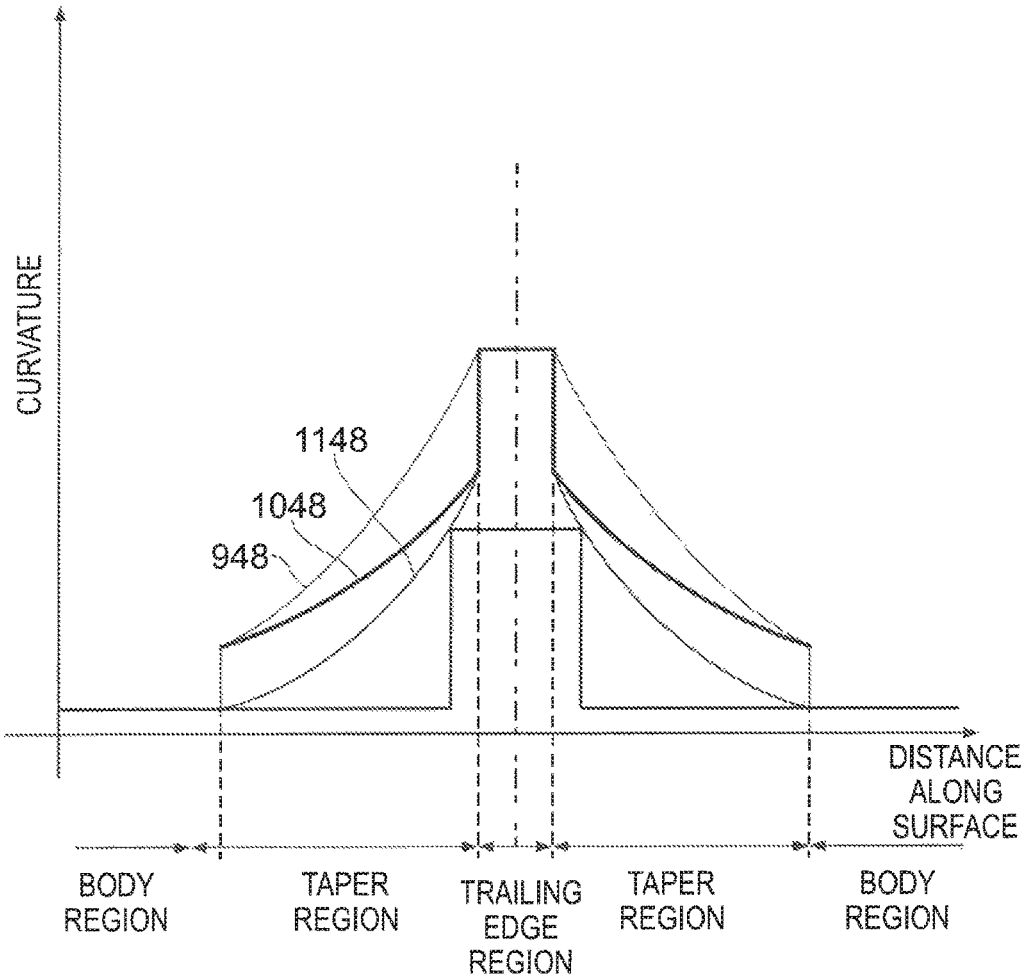

FIG. 11 graphically shows a curvature profile of the end regions of the compressor blades of the fifth and sixth examples of FIGS. 9 and 10;

FIG. 12 shows a cross-sectional profile of an end region of a compressor blade according to a seventh example;

FIG. 13 shows a cross-sectional profile of an end region of a compressor blade according to an eighth example; and FIG. 14 graphically shows a curvature profile of the end regions of compressor blades according to ninth, tenth and eleventh examples.

Figure 1:
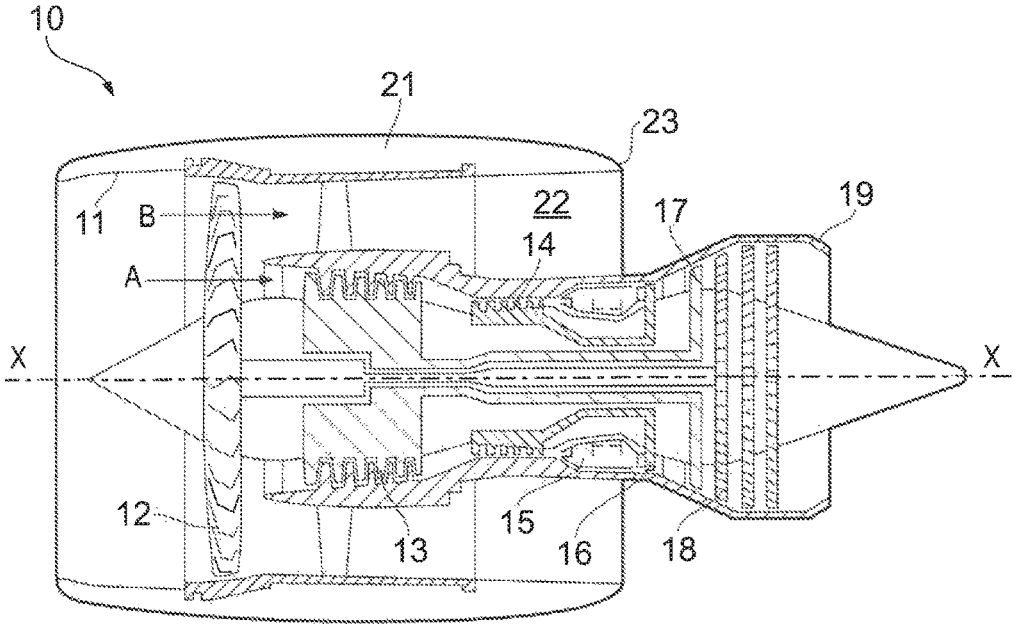

FIG. 1 shows a ducted fan gas turbine engine 10 having a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. The intermediate pressure compressor 13 and the high-pressure compressor 14 are axial compressors of a core flow through the engine (core compressors). A nacelle 21 generally surrounds the engine 10 and defines the intake 11, a bypass duct 22 and a bypass exhaust nozzle 23.

During operation, air entering the intake 11 is accelerated by the fan 12 (which is also a compressor) to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14, where further compression takes place.

The compressed air exhausted from the high-pressure compressor 14 is directed into the combustion equipment 15 where it is mixed with fuel and the mixture is combusted. The resultant hot combustion products then expand through, and thereby drive, the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 2:
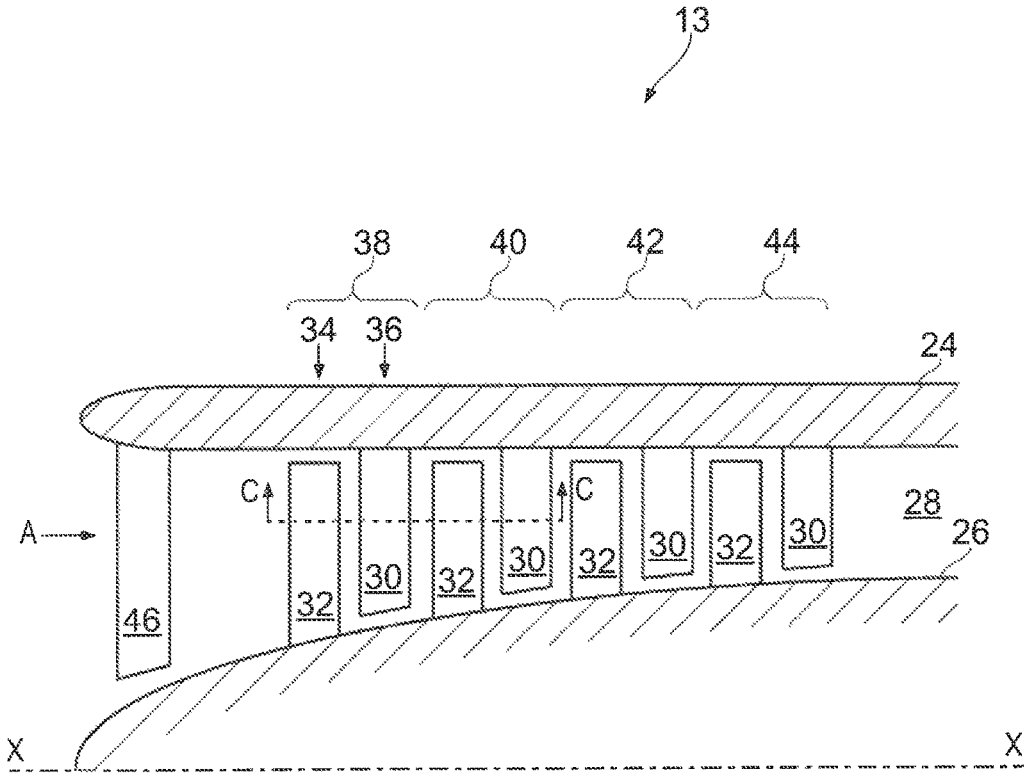

FIG. 2 schematically shows a partial cross-sectional view of the intermediate pressure compressor 13 of FIG. 1. The compressor 13 comprises a stationary annular compressor casing 24, the longitudinal axis of which is aligned with the principal and rotational axis X-X of the gas turbine engine 10. A rotor drum 26 is supported within the compressor casing 24, and is rotatable about the principle and rotational axis X-X. The compressor casing 24 is radially spaced from the rotor drum 26 so as to define an annular passageway, or annulus 28, therebetween. A plurality of circumferentially arranged stator vanes 30 (or stator blades 30) is fixed to and extends from the compressor casing 24 into the annulus 28. Likewise, a plurality of circumferentially arranged rotor blades 32 are fixed to and extend from the rotor drum 26 into the annulus 28.

Figure 3:
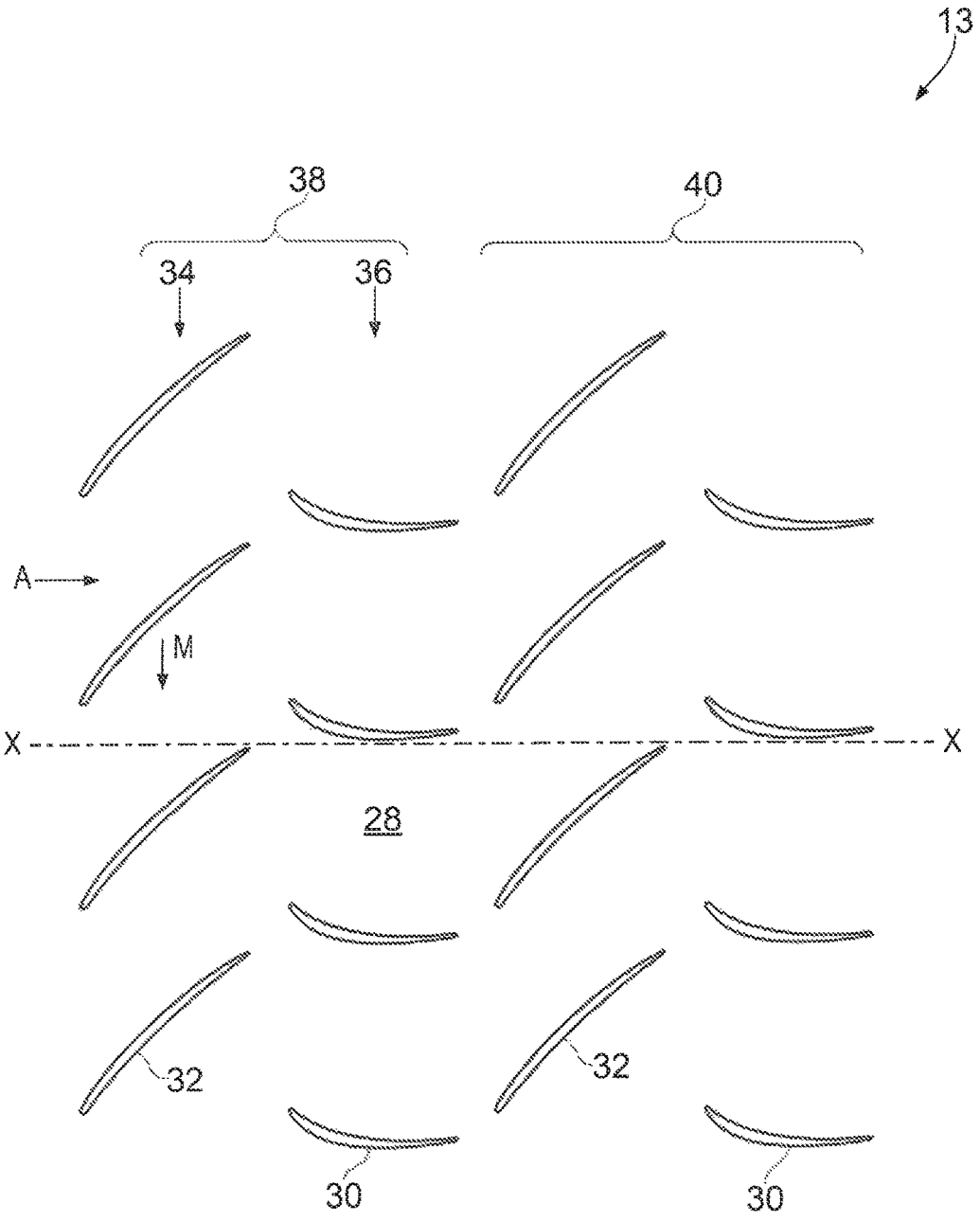

The plurality of rotor blades 32 and stator vanes 30 are arranged in a plurality of discrete circumferentially-extending rows spaced along the length of the rotor drum 26 and the compressor casing 24, respectively. A first row 34 of rotor blades 32 is disposed at an upstream end of the compressor 13. A first row 36 of stator vanes 30 is disposed immediately downstream of the first row 34 of rotor blades 32. The first row 34 of rotor blades 32 and the first row 36 of stator vanes 30 form a first stage 38 of the compressor 13. In the example arrangement shown in FIG. 2, a further three stages 40, 42, 44 are provided, each comprising an upstream row of rotor blades 32 and a downstream row of stator vanes 30. Accordingly, the compressor 13 is a multi-stage compressor. A row of inlet guide vanes 46 is disposed upstream of the first row 34 of rotor blades 32. The inlet guide vanes 46 extend from the compressor casing 24 into the annulus 28, in a similar manner to the stator vanes 30. A row (i.e. a disk) of rotors within a stage may be referred to as a rotor stage, and similarly a row (i.e. a disk) of stators within a stage may be referred to as a stator stage, FIG. 3 shows a cross-sectional view of the compressor 13 taken along the plane C-C of FIG. 2. A total of two stages 38, 40 are shown, each comprising a row of rotor blades 32 and a row of stator vanes 30 extending into the annulus 28. The example rotor blades 32 and stator vanes 30 shown in FIG. 3 have previously-considered cross-sectional aerofoil profiles. In use, the rotor blades 32 rotate in a direction M. The moving rotor blades 32 increase the tangential velocity of the first flow of air A so as to increase its kinetic energy. The stator vanes 30 positioned downstream of the rotor blades 32 subsequently reduce the tangential velocity of the first flow of air A. In doing so, the kinetic energy of the first flow of air A is reduced, and its static pressure increases. Profile losses occur along across each row of rotor blades 32, thereby reducing the efficiency of the system.

Figure 4:
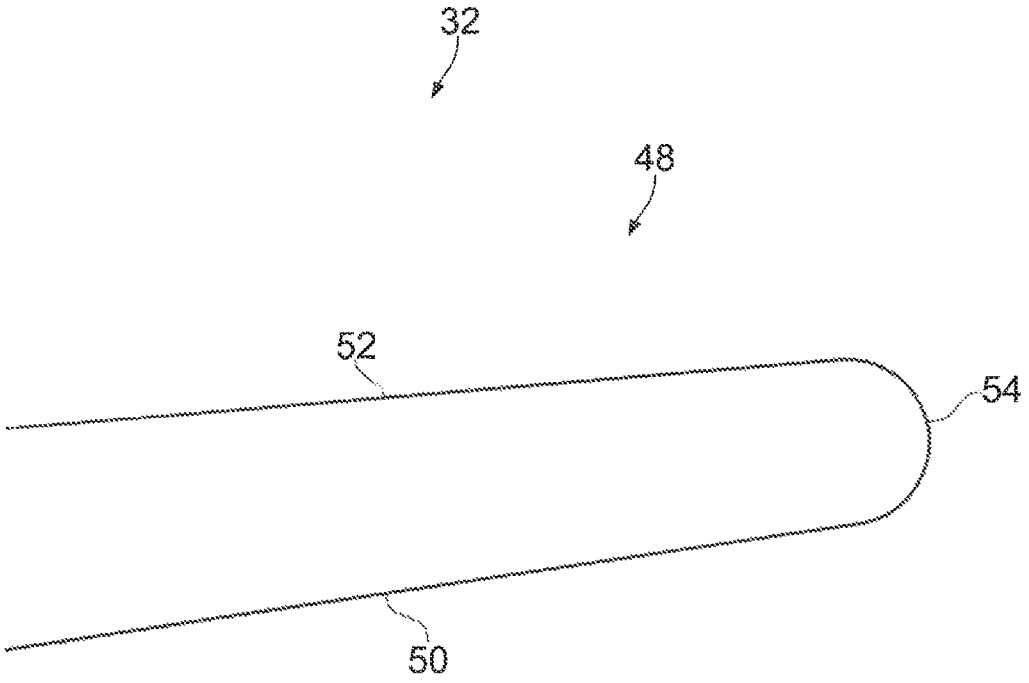
FIG. 4 shows a cross-sectional profile of an end region of a previously-considered compressor blade of FIGS. 1 to 3.

FIG. 4 shows an end region 48 of a cross-sectional aerofoil profile of a rotor blade 32 of FIG. 3. The end region 48 comprises a portion of a pressure surface boundary 50 of the aerofoil profile and a portion of a suction surface boundary 52, which meet at a trailing edge point 54 corresponding to the trailing edge of the blade 32. As shown in FIG. 4, a high-curvature trailing edge region including the trailing edge point 54 has a substantially uniform curvature over an arcuate extent of approximately 180°.

Examples will now be described in which an aerofoil profile of a blade has a significantly reduced thickness in a region adjacent the trailing edge of the blade. The applicant has found that reducing the thickness in this region enables a corresponding reduction in the profile losses (drag) on the blade, as will be described in detail below.

Figure 5:
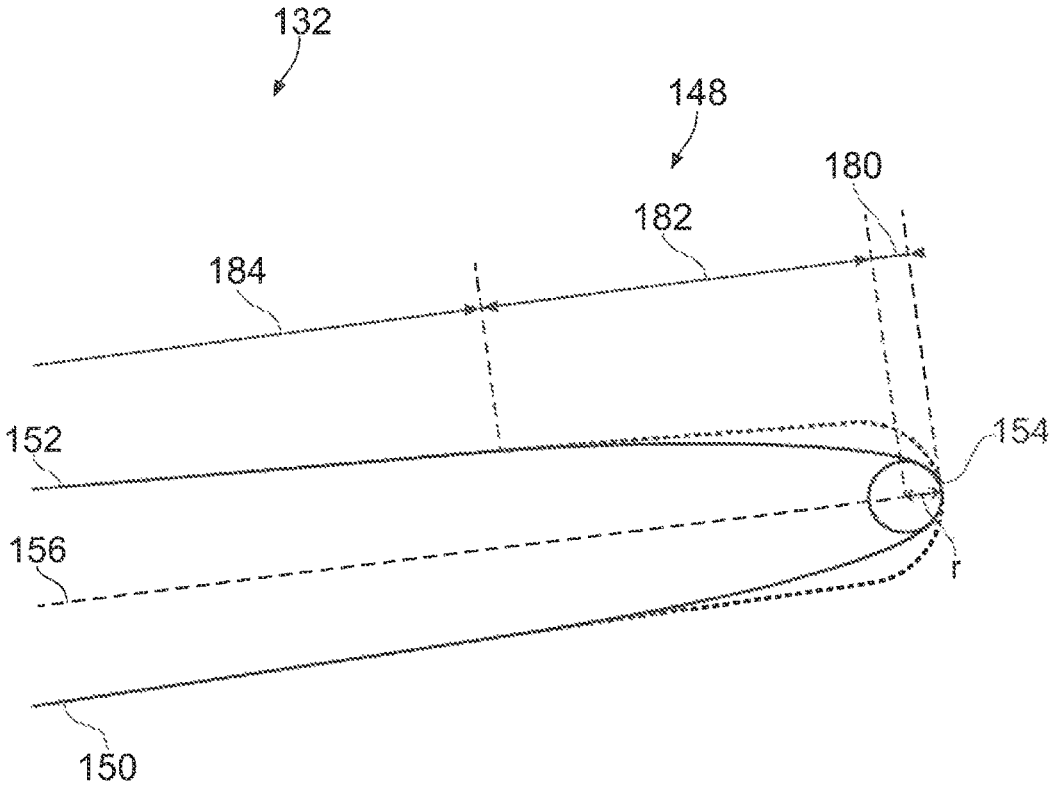
FIG. 5 shows a cross-sectional profile of an end region of a compressor blade according to a first example.

FIG. 5 shows a cross-sectional aerofoil profile of an end region 148 of a first example rotor blade 132. The rotor blade 132 is for a compressor of a gas turbine engine such as that described with reference to FIGS. 1 to 3, and is for use in any or all stages of the compressor 13. Corresponding geometries may be used for blades of the fan 12. The previously-considered rotor blade 32 described above with respect to FIG. 3 (from hereon in, the "baseline blade") is show in dashed lines, for reference. The rotor blade 132 is coupled to a rotor disc as described above, and has a root portion and an aerofoil portion having a spanwise extent within the annulus 28 of the compressor 13. The rotor blade 132 comprises a pressure surface and a suction surface. The point where the pressure surface and the suction surface meet at the rear of the blade defines a trailing edge.

The chord-wise cross-sectional profile of the rotor blade 132 in the aerofoil portion of the rotor blade 132 is therefore in the form of two-dimensional aerofoil having a pressure surface boundary 150, a suction surface boundary 152, and a trailing edge point 154 corresponding to the trailing edge of the blade 132. The chord-wise cross-sectional profile may vary along the spanwise extent of the blade. However, at least a portion of the spanwise extent of the blade 132 (for example, at least 50% of the spanwise extent) has a cross-sectional aerofoil profile as described below.

The curvature of the aerofoil profile of the rotor blade 132 varies through adjacent regions of the blade. In particular, the aerofoil profile includes, in order along the chord of the blade, a leading edge region corresponding to the leading edge of the blade (not shown), a body region 184 corresponding to a central region of the blade, a taper region 182 downstream of the body region 184, and a trailing edge region 180 corresponding to the trailing edge of the blade and downstream of the taper region 182. FIG. 5 shows an end region 148 of the rotor blade 132 including the trailing edge region 180, the taper region 182 and a portion of the body region 184.

The thickness of the aerofoil portion between the pressure surface boundary and the suction surface boundary corresponds to the thickness of the rotor blade 132 at the respective spanwise position. The thickness of the rotor blade 132 varies along a chordwise direction through the adjacent regions described above.

For the purposes of this example and for illustration only, the aerofoil profile of the blade 132 has a chord of 30 mm and a maximum thickness of 2 mm in the body region. The example aerofoil profile corresponds to a mid-span portion of the blade.

The leading edge region may have a chordwise extent of between 5% and 15% of the chord of the rotor blade 132. In this example, the leading edge region has a chordwise extent of 3 mm or approximately 10% of the chord of the rotor blade 132.

In this example, the taper region 182 and the trailing edge region 180 together have a chordwise extent of approximately 2.4 mm, or 8% of the chord. The taper region 182 and trailing edge region 180 will be described in further detail below.

Consequently, the body region 184 between the leading edge region and the taper region 182 has a chord-wise extent of approximately 82% of the chord of the rotor blade 132 (i.e. approximately 24.6 mm in this example).

In this example, the pressure surface boundary and the suction surface boundary each has a substantially constant curvature along the body region 184. In this example, the chord of the blade is approximately 30 mm, and the minimum radius of curvature of the suction surface 152 in the body region is approximately 150 mm, whereas the radius of curvature of the pressure surface 150 is approximately 150 mm. This corresponds to relatively low overall curvature of the blade. In other examples, the curvature of the pressure surface boundary and/or the suction surface boundary may vary within the body region, for example the curvature may be within a range between zero curvature and a curvature corresponding to a radius of curvature equal to the chord of the blade (which may correspond to a turning angle along the blade of approximately 60°). One or more portions of each boundary in the body region may be linear. It will be appreciated that either of the pressure surface boundary and the suction surface boundary in the body region may have regions of high curvature, curvature discontinuities, and/or a discontinuous profile including a notch or projection.

The trailing edge region 180 and the taper region 182 are disposed towards the trailing edge of the blade. The trailing edge region 180 corresponds to the trailing edge of the blade, and the taper region 182 is disposed between the body region 184 and the trailing edge region, as described in further detail below.

The aerofoil profile includes a region of local maximum curvature corresponding to the trailing edge of the blade. This local maximum curvature defines a trailing edge radius of curvature r. The trailing edge radius of curvature r is less than the radius of curvature of the pressure surface boundary 150 and the suction surface boundary 152 in the body region 184 and taper region 182 of the blade. In this example, the trailing edge radius of curvature is approximately 0.15 mm.

The trailing edge region 180 extends from the trailing edge 154 in an upstream direction (i.e. towards the taper region 182) from the trailing edge point 154. The trailing edge region 180 has a chordwise extent equal to the trailing edge radius of curvature r. It will be appreciated that the chordwise extent of the trailing edge region 180 may be greater than the chordwise extent of an arcuate region of maximum curvature corresponding to the trailing edge. The two may be coterminous when the arcuate extent of region of maximum local curvature is 180°, and the trailing edge region 180 may have a greater chord-wise extent when the arcuate extent of such a region is less than 180°.

The taper region 182 has a chordwise extent greater than the trailing edge radius of curvature r. In this example as shown in FIG. 5, the taper region 182 has a chord-wise extent of approximately 2.25 mm, which is equivalent to approximately 15 times the trailing edge radius of curvature r. This corresponds to a chord-wise extent of approximately 7.5%, in this example. In other examples, the taper region 182 may have a chord-wise extent up to 30 times the trailing edge radius of curvature r, or up to 15% of the chord.

As shown in FIG. 5, the thickness of the blade (i.e. the thickness between the pressure surface boundary and the suction surface boundary) reduces along the taper region 182. In this particular example, the thickness reduces along the taper region 182 by approximately 60% from approximately 0.8 mm to approximately 0.32 mm. In other examples, the thickness between the pressure surface boundary and the suction surface boundary may reduce along the taper region 182 by at least 50%, for example between 50% and 85%, or between 60% and 75%.

As apparent from the above, in this example there is a variable thickness distribution within the body region, including from a maximum of 2 mm to approximately 0.8 mm where the body region 184 meets the taper region 182.

In some examples the thickness of the blade may be substantially constant in the body region 184 and may reduce significantly only in the taper region 182 and in the trailing edge region 180.

As a result of the reduction in thickness in the taper region 182, the maximum thickness of the blade in the trailing edge region 180 is less than the minimum thickness of the blade in the body region 184 (for example, the thickness where the body region 184 meets the taper region 182). Similarly, the trailing edge radius of curvature r is less than half the minimum thickness of the blade in the body region 184.

In this example, the aerofoil profile is substantially elliptical and substantially symmetrical in the taper region 182 and the trailing edge portion 180. Accordingly, the curvature of the pressure surface boundary 150 and the suction surface boundary 152 increases in the taper region 182 to define the substantially elliptical boundary, relative to the curvature in the body region 184, thereby progressively reducing the thickness of the blade in the taper region. Whilst the curvature of the pressure surface boundary and/or suctions surface boundary in the body region may generally correspond to the curvature of the camber line in the body region, the curvature of the boundaries in the taper region increases towards the camber line in order to reduce the thickness, in this example. In the present disclosure, curvature is defined with respect to a normal direction into the centre of the blade. Accordingly, curved blades as shown in FIG. 3 have generally positive curvature except for a portion of the pressure surface within the body region of the blade.

In this example the curvature of the pressure surface boundary 150 and the suction surface boundary varies continuously from the body region 184 through the taper region 182 and the trailing edge region 180, such that the profile of the blade is blended in these regions. In the present disclosure, a continuously varying curvature, or a continuous curvature profile, is intended to mean that there are no discontinuities in the profile of curvature (i.e. no sudden changes in curvature). Therefore, a curvature profile which is continuous may include regions of constant curvature, regions of zero curvature, and regions of varying curvature, both positive and negative.

As previously described, the region of local maximum curvature corresponding to the trailing edge of the blade defines a trailing edge radius of curvature r. In this example, the substantially elliptical profile transitions to a circular arc towards the trailing edge, such that the region of maximum curvature at the trailing edge has an arcuate extent. In this example, the arcuate extent is approximately 90°, such that portions of the pressure surface boundary and the suction surface boundary immediately adjacent the trailing edge point 154 lie on an arc of a circle having a radius equal to the trailing edge radius of curvature. In other examples, the arcuate extent may be up to 180°, and may be at least 60°. In yet further examples, the curvature may continue to vary in the trailing edge region 180 so that the maximum curvature (i.e. minimum radius of curvature) only occurs at the trailing edge point 154.

In this example, the pressure surface boundary 150 and the suction surface boundary in the taper region 182 each define a Bezier curve between body region and the arcuate portion of the trailing edge region 180. Owing to the continuous curvature profile from the body region and through the taper region and body regions, the pressure surface boundary 150 and the suction surface boundary 152 each define a smooth, graduated or blended joint between the body region 184 and the taper region 182, and similarly between the trailing edge region 180 and the taper region 182.

Since the curvature increases in the taper region 182 towards the trailing edge point 154 to effect the reduction in thickness described above, the maximum absolute curvature of both the pressure surface boundary 150 and the suction surface boundary 152 in the taper region 182 is greater than the maximum absolute curvature of the pressure surface boundary 150 and the suction surface boundary 152 in the body region 184.

With the normal direction of curvature considered to be inward (i.e. towards the camber line, rather than outward), the curvature of the pressure surface boundary and the suction surface boundary increases relative the curvature of these respective boundaries in the body region 184. As described above, in this example the pressure surface boundary 150 has negative curvature in the body region 184, and therefore the increase in curvature in the taper region causes the sign of the curvature to change.

In an example of use, rotor blades 132 are incorporated in a plurality of rotor stages in a multi-stage axial compressor, and caused to turn to compress an airflow passing therethrough. The applicant has found that the reduced thickness in the taper region and trailing edge region of the blade, resulting in a reduced radius of curvature towards the trailing edge, results in a reduction in profile losses (i.e. drag) when compared to the previously-considered blade 132.

The applicant has found that the improvement in the pressure losses may be particularly beneficial (i.e. with respect to the overall losses in the compressor) with respect to smaller geometry compressors. It will be appreciated that trends for increasing bypass ratios and compression ratios call for smaller-geometry compressors. Whilst compressor blades, particularly for relatively small-annulus compressors for the core of a gas turbine engine (e.g. having an aerofoil portion with a span of up to 50 mm) tend to have a relatively constant thickness over the chord of the blade to meet minimum structural requirements, the applicant has found that the minimum thickness towards the trailing edge (i.e. in the taper region and the trailing edge region) can be reduced to enable the improvement in profile losses.

The above effects of reducing thickness in the taper region may apply equally to the further examples described below. Further examples relate to particular features of the aerofoil profile which may enable the reduced thickness to be implemented whilst optimising other aerodynamic properties, such as the exit flow angle of the blade.

Figure 6:
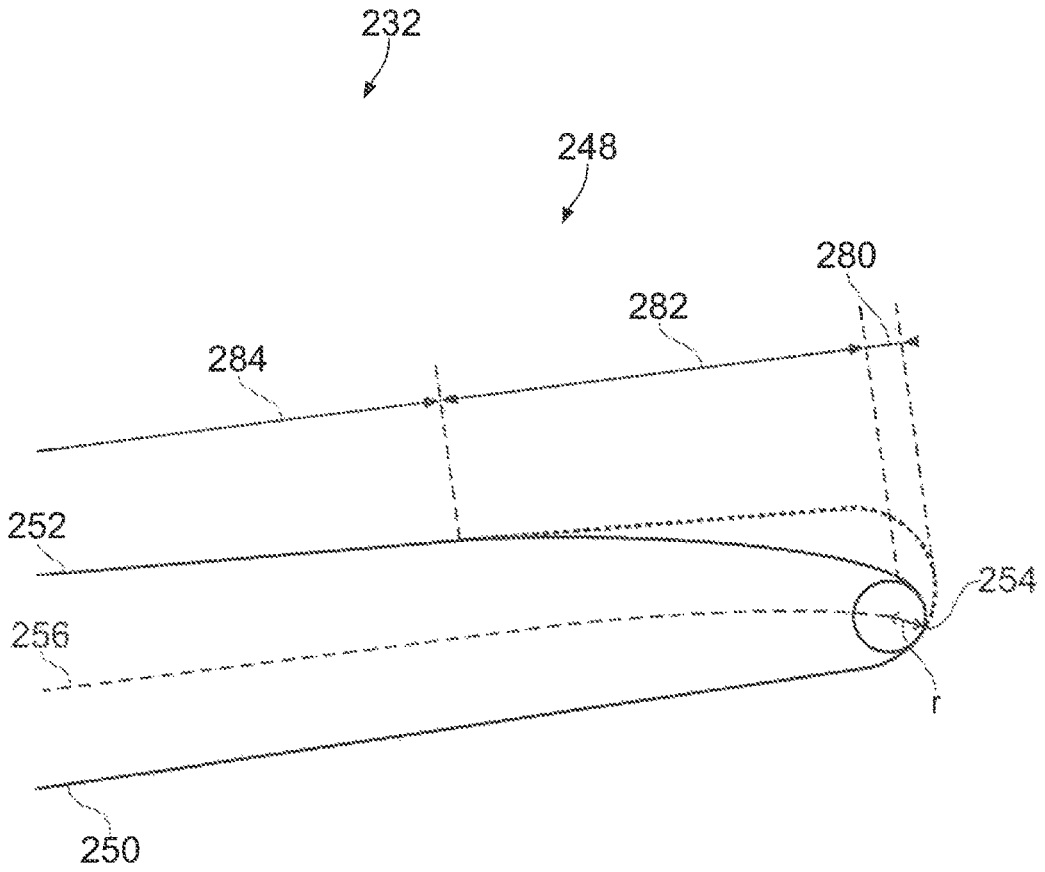
FIG. 6 shows a cross-sectional profile of an end region of a compressor blade according to a second example.

FIG. 6 shows an end region 248 of a cross-sectional aerofoil profile a rotor blade 232 according to a second example. The rotor blade 232 of FIG. 6 is similar to the rotor blade 132 of FIG. 5 in that it has a leading edge region, a body region 284, a taper region 282 and a trailing edge 280, each of corresponding chord-wise extent and overall dimensions to the example of FIG. 5. However, the rotor blade 232 of FIG. 6 differs in the profile of the taper region 282 and the trailing edge region 280. In particular, the pressure surface boundary 250 and the suction surface boundary 252 in the taper region 282 are biased towards the pressure surface 250, when compared to the profile of the end region 48 of the previously-considered blade (shown in dashed lines). Accordingly, the end region 248 of the rotor blade 232 is asymmetric.

In particular, the profile of the pressure surface boundary 250 in the taper region 282 is continuous with the profile of the pressure surface boundary 250 in the body region 284, whereas the profile of the suction surface 252 in the taper region 282 departs or deflects from the profile of the suction surface 252 in the body region, thereby biasing the taper region 282 and the trailing edge region 280 to the pressure surface of the blade. In this example, the curvature of the pressure surface boundary 250 in the taper region does not change significantly relative the curvature of the pressure surface boundary 250 in the body region 284. In this simplified example, the radius of curvature of the pressure surface boundary 250 remains substantially constant in the taper region 282 and is equal to the radius of curvature of the body region 284 where the body region meets the taper region 282.

In contrast, the curvature of the suction surface boundary 252 increases in the taper region 282 relative the curvature of the suction surface boundary 252 in the body region 284. For example, the minimum radius of curvature (corresponding to the maximum curvature) for the suction surface boundary 252 in the taper region 284 may be approximately 0.3 mm, whereas the minimum radius of curvature for the suction surface boundary 252 in the body region 284 may be significantly larger, for example at least 30 mm, for example approximately 100 mm. As described above with respect the blade 132 of FIG. 5, the curvature profile of the suction surface boundary 252 in this example is continuous.

In this example, the trailing edge region 280 includes a region of local maximum curvature corresponding to the trailing edge and including a trailing edge point 254 of the aerofoil, as described above with respect to FIG. 1. In this example, the arcuate region of local maximum curvature has an arcuate extent of approximately 100°, and includes the trailing edge point 254 and corresponding portions of the pressure surface boundary 250 and suction surface boundary 252, The curvature of a portion of the pressure surface boundary 250 immediately adjacent the trailing edge region 280 increases relative the curvature of the pressure surface boundary 252 in the body region 284, so as to form the respective portion of the an arcuate region of local maximum curvature and maintain a continuous curvature profile.

Consequently, the portion of the camber line 256 of the aerofoil profile in the taper region 282 (and thus the trailing edge region 280) is deflected or angled relative to the adjacent portion of the camber line 256 in the body region 284. In this particular example, and as shown in FIG. 6, the camber line 256 in the body region 284 has approximately zero curvature. However, in alternate arrangements, the camber line 256 in the body region 284 may be curved. As such, in this particular example the curvature of the camber line 256 is greater in the taper region 282 than in the body region 284, when the normal direction (of curvature) is towards the pressure surface of the blade.

Biasing the aerofoil profile towards a respective surface of the blade may enable a desired exit flow direction of the blade to be achieved. Further, biasing the aerofoil profile towards a respective surface of the blade may enable the reduction in thickness to be effected by relatively larger changes in curvature or deflection in one of the boundaries (i.e. the pressure surface boundary and the suction surface boundary) than the other. This may be desirable, for example, when the flow regime along one of the boundaries is more sensitive to design changes. For example, the flow along one of the boundaries may be able to tolerate such changes in the curvature profile than flow along the other boundary (e.g. resistance to separation).

Figure 7:
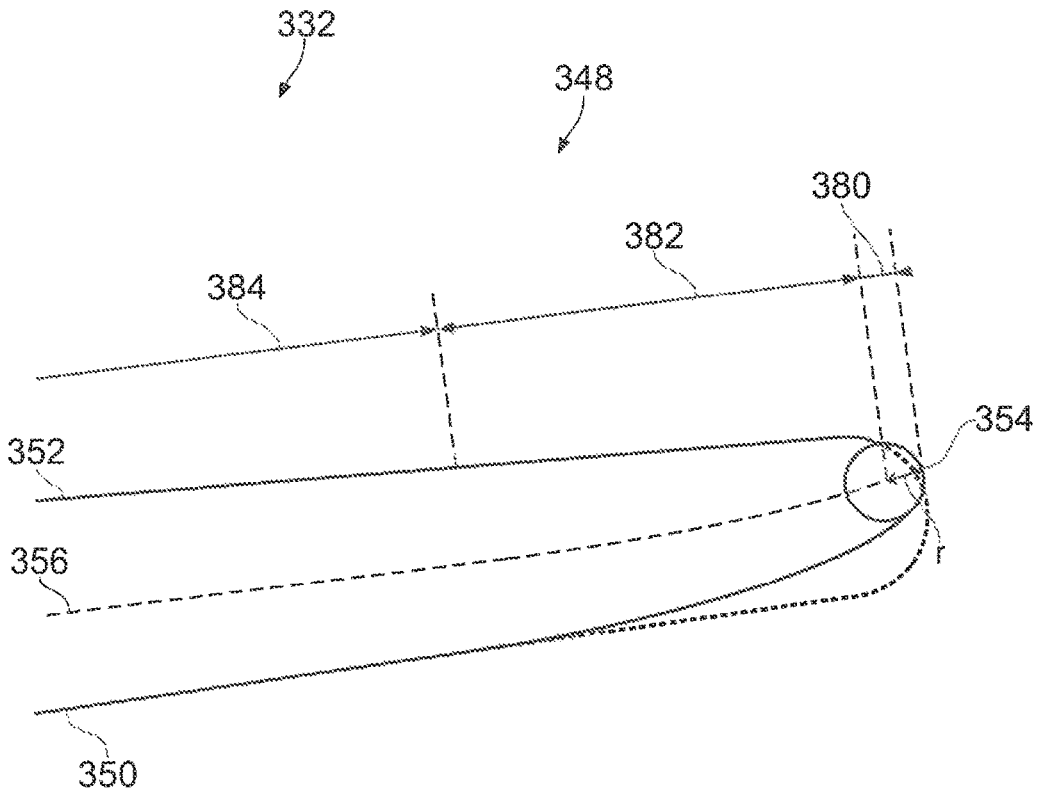
FIG. 7 shows a cross-sectional profile of an end region of a compressor blade according to a third example.

FIG. 7 shows an end region 348 of a cross-sectional aerofoil profile of a rotor blade 332 according to a third example. This third example essentially corresponds to the inverse of the second example rotor blade 232 described above with respect to FIG. 6, in that the taper region 382 is biased towards the suction surface, rather than the pressure surface of the blade. Accordingly, the above description of features relating to the pressure surface boundary 250 of FIG. 6 apply to the suction surface boundary 352 of the blade 332 of FIG. 7, whereas the above description of features relating to the suction surface boundary 252 apply to the pressure surface boundary 350 of the blade 332 of FIG. 7. Similarly, the camber line 356 in this example has negative curvature in the tip region 382 (rather than positive curvature), when the normal direction is defined towards the pressure surface of the blade.

Figure 8:
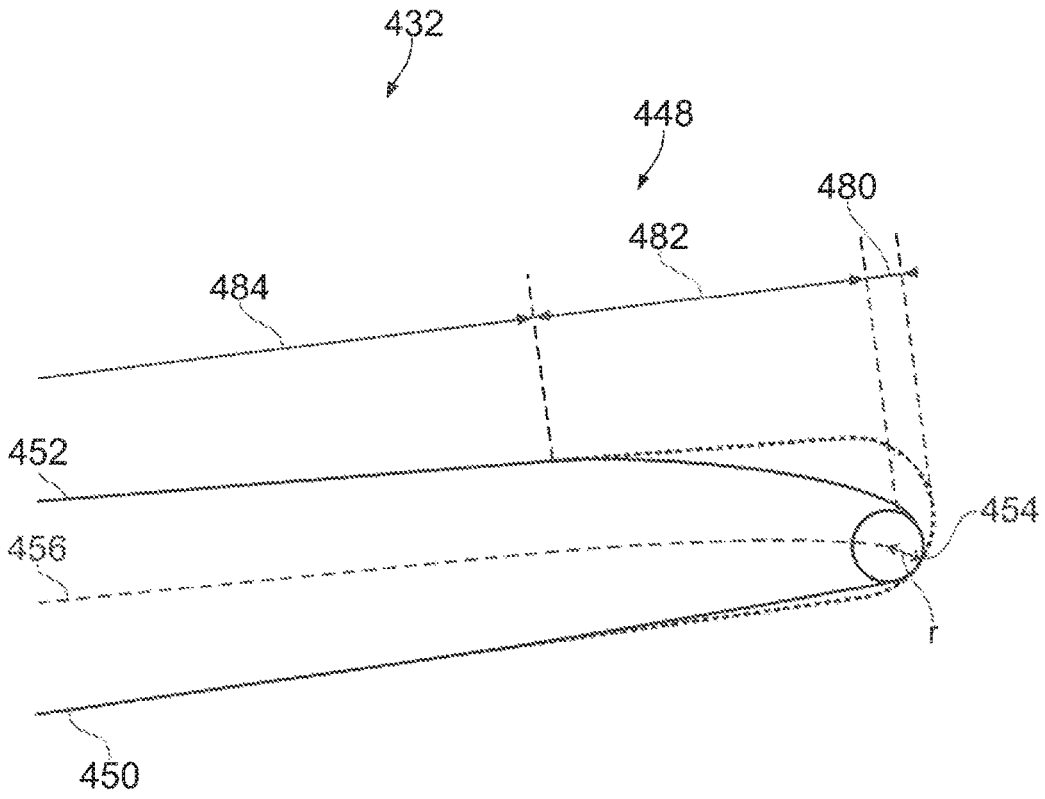
FIG. 8 shows a cross-sectional profile of an end region of a compressor blade according to a fourth example.

FIG. 8 shows an end region 448 of a cross-sectional aerofoil profile of a rotor blade 432 according to a fourth example. The rotor blade 432 of FIG. 8 is similar to the rotor blade 432 described above with respect to FIG. 6. However, the extent by which the pressure surface boundary 450 and the suction surface boundary 452 are biased towards the pressure surface of the blade in the taper region 482 is reduced. Accordingly, in this example the curvature of the pressure surface boundary 450 in the taper region 482 increases relative the curvature of the pressure surface boundary 450 in the body region 484, rather than the profile of the pressure surface boundary 450 being continuous with that in the body region 484. Nevertheless, the curvature of the suction surface boundary along the taper region 482 is greater than the curvature of the pressure surface boundary along the taper region 482, such that the reduction in thickness is effected largely due to the curvature of the suction surface boundary 482.

The applicant has found that this profile, which may be considered as partially biased towards the pressure surface, may enable the aerodynamic performance of the blade 432 to substantially match that of the previously considered blade 32 described above with respect to FIG. 4. In particular, the applicant has found that the increase in curvature in the pressure surface boundary 450 in the taper region 482 may offset a change in exit flow direction that may occur due to the modified profile of the suction surface boundary 452 in the taper region 482 (i.e. which departs from the profile of the suction surface boundary 452 in the body region 484), whilst enabling a significant reduction in thickness.

FIG. 9 shows an end region 548 of a cross-sectional aerofoil profile of a rotor blade 532 according to a fifth example. The rotor blade 532 of FIG. 9 substantially corresponds to the rotor blade 332 of FIG. 7. However, in this example, the curvature profile of the pressure surface boundary 550 in the taper region 582 is modified so that a portion has zero curvature (i.e. it is linear). The curvature profile of the pressure surface boundary 550 from the body region 584 and through the taper region 582 is continuous, as in previous examples, such that there is a smooth, graduated or blended profile between the portion of the pressure surface boundary in the body region 584 and the portion in the taper region 582, including the region having zero curvature. However, in this example, the curvature profile is discontinuous where the pressure surface boundary curves to form the arcuate region of local maximum curvature corresponding to the trailing edge of the blade, and includes the trailing edge point 554. This is best shown in FIG. 11, which shows the curvature profile of the pressure surface boundary 550 continuously varying from the body region into the taper region, but shows a discontinuity at the arcuate region of local maximum curvature corresponding to the trailing edge.

The linear profile may allow for easier manufacture, and may result in a steeper reduction in thickness without resulting in a region of negative curvature.

FIG. 10 shows an end region a cross-sectional aerofoil profile of an end region 648 of a rotor blade 632 according to a sixth example. The rotor blade 632 of FIG. 10 substantially corresponds to the rotor blade 332 of FIG. 7. However, in this example, the curvature profile of the pressure surface boundary 650 in the taper region 682 is modified to have an inflected profile.

In particular, the curvature of a first portion of the pressure surface boundary 650 in the taper region 682, adjacent the body region 684, increases relative the curvature in the body region 684 to result in a region of high curvature (i.e. curving towards the suction surface boundary 652). The curvature then reduces to zero and turns negative for a second portion of the pressure surface boundary 650 in the taper region 682 extending towards the trailing edge region. The pressure surface boundary is therefore concave, recessed or depressed adjacent the trailing edge region. The curvature profile is again continuous from the body region 684 and through the taper region 682, such that there are smooth, graduated or blended transitions therebetween. However, as described above with respect to FIG. 9, the curvature profile is discontinuous where the pressure surface boundary 652 curves to form the arcuate region of local maximum curvature corresponding to the trailing edge of the blade 632, as also shown in FIG. 11.

As with the third example, the portion of the camber line 556 of the aerofoil profile in the taper region 582 (and thus the trailing edge region 580) is deflected or angled relative to the adjacent portion of the camber line 556 in the body region 584 towards the suction surface of the blade. Owing to the profile of the pressure surface in the taper region 648, the camber line has a portion of negative curvature (i.e. curvature towards the suction surface of the blade), followed by an inflection and a portion of positive curvature (i.e. curvature towards the pressure surface of the blade), when the normal direction is towards the pressure surface. In this particular example, and as shown in FIG. 10, the camber line 556 in the body region 584 has approximately zero curvature. However, in alternate arrangements, the camber line 556 in the body region 584 may be curved. As such, the absolute curvature of the camber line 556 may be greater in the taper region 582 than in the body region 584, when the normal direction (of curvature) is towards the pressure surface of the blade.

The inflected profile of the pressure surface in this example may enable for the exit flow direction to recover, after the reduction in thickness, towards a direction corresponding to the flow upstream of the taper region. In other words, the change in flow direction over a first portion of the taper region may be reversed. The inflected profile may therefore enable the reduction in thickness to be achieved whilst achieving a desired exit flow direction.

FIG. 11 shows curvature profiles of the end regions 548, 648 of the rotor blades 532, 632 of FIGS. 9 and 10 respectively. In particular, FIG. 11 shows a plot of the magnitude of curvature of the pressure surface boundaries and the suction surface boundaries of FIGS. 9 and 10 in relation to the distance along their respective surfaces. A plot of the curvature profile of the end region 48 of FIG. 4 has also been included for reference. As shown in FIG. 11, the curvature profiles for the end regions 548, 648 are continuous from the respective body regions and through the taper region, but there is a discontinuity in curvature where the pressure surface boundaries curve to define the arcuate region of constant local maximum curvature corresponding to the trailing edge of the respective blades. The curvature profiles of the suction surfaces are continuous along their length.

FIG. 12 shows an end region 748 of a cross-sectional aerofoil profile of a rotor blade 732 according to a seventh example. The rotor blade 732 of FIG. 12 substantially corresponds to the rotor blade 332 of FIG. 7. However, in this example, the curvature profile of the pressure surface boundary 750 has discontinuities corresponding to the junction between the body region 784 and the taper region 782, and where the pressure surface boundary curves to form the arcuate region of local maximum curvature corresponding to the trailing edge of the blade 732. In this example, there is a region of zero curvature therebetween. Accordingly, there is an angular join, edge or discontinuity formed between the portion of the pressure surface boundary 750 in the taper region 782 having zero curvature and the portion of the pressure surface boundary 750 in the body region 784.

FIG. 13 shows an end region 848 of a cross-sectional aerofoil profile of a rotor blade 832 according to an eighth example. The rotor blade 832 of FIG. 13 substantially corresponds to the rotor blade 632 of FIG. 10. In particular, the portion of the pressure surface boundary 850 deflects in the taper region 882 relative to the portion of the pressure surface boundary 850 in the body region 884 so that the pressure surface boundary 850 is inflected in the taper region 882 and there is a change of sign of curvature from positive to negative in the taper region 882. As with the rotor blade 632 of FIG. 10, the profile of the camber line 756 in the taper region deflects away from the profile of the camber line 756 in the body region 884, and thereby has a region of negative curvature in a portion of the taper region 882 adjacent the body region 884 (when the normal direction is towards the pressure surface). However, in this example, the suction surface boundary 852 increases in curvature (i.e. towards the pressure surface) in a portion of the taper region 882 adjacent the trailing edge region 880, so as to offset any bias of the trailing edge region 880 towards the suction surface of the blade. Accordingly, the camber line 856 of the rotor blade 832 is inflected and has a further region of positive curvature as it approaches the trailing edge region 880 of the blade 832.

The inflected camber line in this example represents a further means of controlling the exit flow direction, whilst achieving the desired reduction in thickness.

FIG. 14 shows further example curvature profiles of end regions 948, 1048, 1148 of rotor blades according to ninth, tenth and eleventh examples. The respective trailing edge regions, taper regions and body regions are defined with respect to the distance along the respective pressure and suction surface boundaries. A plot of the curvature profile of the end region 48 of the previously-considered blade 32 of FIG. 4 has also been included for reference.

The end regions 948, 1048, 1148 of rotor blades according to the ninth, tenth and eleventh aspects substantially correspond to the rotor blade of FIG. 5. However, curvature discontinuities exist in the following locations in these examples: between the pressure surface boundary in the body region and the pressure surface boundary in the taper region in the ninth example; between the pressure surface boundary in the body region and the pressure surface boundary in the taper region in the tenth aspect; between the pressure surface boundary in the taper region and the pressure surface boundary in the trailing edge region in the tenth aspect; and between the pressure surface boundary in the taper region and the pressure surface boundary in the trailing edge region in the eleventh aspect. Corresponding curvature discontinuities exist on the suction surface boundary of the trailing edges 948, 1048, 1148.

In the foregoing description, it has been described that portions of the pressure surface boundaries and the suction surface boundaries immediately adjacent each of the trailing edges form arcs of circles. They may, however, be of any profile. For example, they may form an arc of an ellipse.

Example blades have been described by reference to a cross-sectional aerofoil profile. An example blade may have a variable cross-sectional aerofoil profile along its spanwise extent, including one or more aerofoil profiles as described above. In some examples, the cross-sectional aerofoil profile of a blade may be constant along its spanwise extent (at least for the aerofoil portion of the blade), or over a substantial span thereof.

It will be appreciated that the features of a pressure surface boundary and a suction surface boundary in a non-symmetrical end region as described above may be inverted, for example, so that an end region biased towards a suction surface of a blade is biased towards the pressure surface of the blade, and vice versa.

Although it has been described that the aerofoil profile is of a rotor blade, it may alternatively be of a stator blade (also known as a stator vane).

Examples have been described in which the blades are rotor blades for compressors for gas turbine engines. However, compressor blades according to the disclosure may be for any type of axial compressor, and may be rotor blades or stator blades. The rotor blades may be used in a compressor of a steam turbine, for example.

Whilst examples have been described herein relating to compressor blades for a core compressor of a gas turbine engine, it will be appreciated that aspects of the disclosure apply equally to fan blades, and also to turbine blades, including both rotor blades and stator blades.

The invention claimed is:

1. A blade for an axial flow machine having a pressure surface, a suction surface and a trailing edge, the blade having a cross-sectional aerofoil profile comprising:

a region of maximum curvature corresponding to the trailing edge of the blade and defining a trailing edge radius of curvature;

a trailing edge region extending from the trailing edge and having a first chordwise extent equal to the trailing edge radius of curvature;

a taper region distinct from and immediately adjacent to the trailing edge region, the taper region having a second chordwise extent different from the first chordwise extent and greater than the trailing edge radius of curvature and no more than 15% of the chord of the blade;

a body region adjacent the taper region;

a pressure surface boundary corresponding to the pressure surface of the blade; and a suction surface boundary corresponding to the suction surface of the blade;

wherein a thickness between the pressure surface boundary and the suction surface boundary reduces within the taper region towards the trailing edge by at least 50%, wherein the profile of the suction surface boundary in the taper region is substantially continuous with the profile of the suction surface boundary in the body region, and wherein the profile of the pressure surface boundary in the taper region departs from the profile of the pressure surface boundary in the body region towards the suction surface boundary, such that the aerofoil profile of the blade is biased towards the suction surface in the taper region and the trailing edge region, and wherein a maximum absolute curvature of at least one of the pressure surface boundary and the suction surface boundary in the taper region is greater than a maximum absolute curvature of the respective pressure surface boundary and the suction surface boundary in the body region.

2. A blade according to claim 1, wherein the chordwise extent of the taper region is no more than 30 times the trailing edge radius of curvature.

3. A blade according to claim 1, further comprising a leading edge region having a chordwise extent of between 5% and 15% of the chord of the blade, and wherein the body region extends between the leading edge region and the taper region.

4. A blade according to claim 1, wherein the curvature of the pressure surface boundary and/or the suction surface boundary is continuous in the taper region.

5. A blade according to claim 1, wherein the curvature of the pressure surface boundary and/or the suction surface boundary is continuous between the taper region and the body region.

6. A blade according to claim 1, wherein the curvature of the pressure surface boundary and/or the curvature of the suction surface boundary changes sign from positive to negative in the taper region, when the normal direction of curvature is inward.

7. A blade according to claim 1, wherein a portion of the pressure surface boundary and/or the suction surface boundary has zero curvature in the taper region.

8. A blade according to claim 1, wherein a portion of the camber line of the aerofoil profile is deflected in the taper region relative to a portion of the camber line in the body region.

9. A blade according to claim 8, wherein the curvature of the camber line in the taper region increases relative the curvature of the camber line in the body region, when the normal direction is towards the pressure surface.

10. A blade according to claim 1, wherein the region of maximum curvature forms an arc of a circle.

11. A blade according to claim 10, wherein the arc of the circle formed by the region of maximum curvature has an angular extent of at least 60°.

12. A gas turbine engine comprising a multi-stage axial compressor, the compressor comprising a plurality of rotor stages and a plurality of stator stages, at least one rotor stage or stator stage comprising a blade in according to claim 1.

13. A blade for an axial flow machine having a pressure surface, a suction surface and a trailing edge, the blade having a cross-sectional aerofoil profile comprising:

a region of maximum curvature corresponding to the trailing edge of the blade and defining a trailing edge radius of curvature;

a trailing edge region extending from the trailing edge and having a first chordwise extent equal to the trailing edge radius of curvature;

a taper region distinct from and immediately adjacent to the trailing edge region, the taper region having a second chordwise extent different from the first chordwise extent and greater than the trailing edge radius of curvature and no more than 15% of the chord of the blade;

a body region adjacent the taper region;

a pressure surface boundary corresponding to the pressure surface of the blade; and a suction surface boundary corresponding to the suction surface of the blade;

wherein a thickness between the pressure surface boundary and the suction surface boundary reduces within the taper region towards the trailing edge by at least 50%, and wherein the profile of the pressure surface boundary in the taper region is substantially continuous with the profile of the pressure surface boundary in the body region, and wherein the profile of the suction surface boundary in the taper region departs from the profile of the suction surface boundary in the body region towards the pressure surface boundary, such that the aerofoil profile of the blade is biased towards the pressure surface in the taper region and the trailing edge region, and wherein a maximum absolute curvature of at least one of the pressure surface boundary and the suction surface boundary in the taper region is greater than a maximum absolute curvature of the respective pressure surface boundary and the suction surface boundary in the body region.

14. A blade according to claim 13, wherein the chordwise extent of the taper region is no more than 30 times the trailing edge radius of curvature.

15. A blade according to claim 13, further comprising a leading edge region having a chordwise extent of between 5% and 15% of the chord of the blade, and wherein the body region extends between the leading edge region and the taper region.

16. A blade according to claim 13, wherein the curvature of the pressure surface boundary and/or the suction surface boundary is continuous in the taper region.

17. A blade according to claim 13, wherein the curvature of the pressure surface boundary and/or the suction surface boundary is continuous between the taper region and the body region.

18. A blade according to claim 13, wherein the curvature of the pressure surface boundary and/or the curvature of the suction surface boundary changes sign from positive to negative in the taper region, when the normal direction of curvature is inward.

* * * * *